US008944539B2

(12) United States Patent
Ramm et al.

(10) Patent No.: US 8,944,539 B2
(45) Date of Patent: Feb. 3, 2015

(54) SEALING SYSTEM FOR REFRIGERATOR

(75) Inventors: Axel Julio Ramm, Joinville (BR); Gustavo Frattini, Joinville (BR)

(73) Assignee: Whirlpool S.A., Sao Paulo, SP (BR)

( * ) Notice: Subject to any disclaimer, the term of this patent is extended or adjusted under 35 U.S.C. 154(b) by 169 days.

(21) Appl. No.: 13/450,107

(22) Filed: Apr. 18, 2012

(65) Prior Publication Data

US 2012/0319551 A1 Dec. 20, 2012

(30) Foreign Application Priority Data

Apr. 18, 2011 (BR) ..... 1101701

(51) Int. Cl.
*A47B 96/00* (2006.01)
*F25D 23/08* (2006.01)

(52) U.S. Cl.
CPC ..... *F25D 23/087* (2013.01)
USPC ..... 312/405; 312/296; 49/489.1

(58) Field of Classification Search
CPC ..... F25D 23/082; F25D 23/087; E06B 7/232; E05C 19/161; B60J 10/085
USPC ..... 312/296, 401, 405, 405.1; 49/478.1, 49/489.1, 475.1, 483.1; 220/592.02, 220/592.06, 592.07
See application file for complete search history.

(56) References Cited

U.S. PATENT DOCUMENTS

| | | | | |
|---|---|---|---|---|
| 2,337,316 | A * | 12/1943 | Dodge | 220/378 |
| 2,899,256 | A * | 8/1959 | Kelley | 312/296 |
| 5,476,318 | A * | 12/1995 | Yingst et al. | 312/405 |
| 6,227,634 | B1 | 5/2001 | Cittadini et al. | |
| 6,526,698 | B2 | 3/2003 | Park et al. | |
| 2002/0184828 | A1 * | 12/2002 | Park et al. | 49/489.1 |
| 2004/0244297 | A1 | 12/2004 | Schuster et al. | |
| 2005/0189726 | A1 * | 9/2005 | Shin | 277/628 |
| 2006/0188690 | A1 | 8/2006 | Jun | |
| 2009/0079141 | A1 * | 3/2009 | Qiang et al. | 277/650 |
| 2009/0243453 | A1 * | 10/2009 | Kang et al. | 312/405 |

FOREIGN PATENT DOCUMENTS

| | | | |
|---|---|---|---|
| BR | PI 0503971-1 | A | 5/2007 |
| WO | 00/14466 | A1 | 3/2000 |

* cited by examiner

*Primary Examiner* — James O Hansen
(74) *Attorney, Agent, or Firm* — Brian J. Colandreo; Michael T. Abramson; Holland & Knight LLP

(57) ABSTRACT

The present invention discloses a sealing system for a refrigerator and, more particularly, a sealing system located between the doors of a refrigerator and its acclimatized chambers and of the kind that comprises a gasket to be inserted in a receiving channel existing also between the doors of a refrigerator and its acclimatized chambers. The sealing system for refrigerator herein reported consists of at least one gasket comprising a tubular body formed by at least one attaching end and by at least one sealing body; at least one groove defined in at least one movable door or at least one fixed cabinet; and by at least one rib defined in at least one movable door or at least one fixed cabinet.

11 Claims, 3 Drawing Sheets

SEALING SYSTEM FOR REFRIGERATOR

CROSS-REFERENCE TO RELATED APPLICATIONS

This application claims priority to and the benefit of Brazilian Patent Application No. PI1101701-5, filed Apr. 18, 2011, the entire disclosure of which is incorporated herein by reference in its entirety.

FIELD OF THE INVENTION

The present invention relates to a sealing system for a refrigerator and, more particularly, to a sealing system located between the doors of a refrigerator and its acclimatized chambers and of the kind that comprises a gasket to be inserted in a receiving channel existing also between the doors of a refrigerator and its acclimatized chambers.

BACKGROUND OF THE INVENTION

Sealing the door of the refrigerated compartment of a refrigerator or freezer is essential for grating proper and efficient refrigeration. The inlet of hot air in the generated refrigerated compartment and the outlet of cool air from the same impact the efficiency in pre-serving the refrigeration, the energy consumption (excessive activation of the compressor), and may still cause water formation in the inside and outside of the compartment due to condensation or unwanted ice formation.

The most commonly used way to carry out the sealing of the refrigerator door is by means of a magnetic gasket. This gasket generally comprises an attachment portion and a sealing bag housing a magnet. The attachment part is received in a receiving channel disposed in a peripheral inner portion of the refrigerator door, and the magnet is housed in the sealing bag which contacts a metallic flange of the body of the refrigerator in order to assure the proper sealing of the door.

Considering the desired properties for the gasket, a number of different constructions and geometries were proposed for a sealing gasket. Those constructions are known, for example, from documents PI 9913633-3, U.S. Pat. Nos. 6,227,634, 6,526,698, US 2004/0244297, US 2006/0188690 and PI 0503971-1.

Document PI 9913633-3 describes a gasket whose attachment portion comprises at least three fixing noses, one of the noses presenting, with the vertical, a more obtuse intermediate angle than the other two fixing noses.

Document U.S. Pat. No. 6,227,634 describes a gasket developed for better resisting to the compression and traction forces acting over it as the door is being moved. The solution provided in this document consists of using two different materials for making part of the sealing bag.

Document U.S. Pat. No. 6,526,698 describes a sealing system for the refrigerator door, wherein the receiving channel of the attachment portion of the gasket has an asymmetric profile, so as to facilitate gasket assembling.

Document US 2004/0244297 describes profiles for the sealing bag of a gasket. According to this document, an additional flap in the bag is predicted which transmits magnetic tension force from the magnet region to the attachment portion region of the gasket.

Document US 2006/0188690 describes a gasket made from a specific material, which would have better extrusion properties.

Finally, document PI 0503971-1 describes a gasket having an attachment portion with a curved profile and a sealing bag subdivided into a side sealing bag, an intermediate sealing bag, a main sealing bag, three secondary sealing bags, and a magnet compartment.

Although the listed documents represent efforts in the sense of achieving a construction of an efficient sealing gasket with long-lasting service life, it remains the search for a solution that allies cost efficiency and manufacturing ease to a gasket having good properties of variation absorption and traction resistance, compression resistance and torsion resistance.

OBJECTS OF THE INVENTION

In view of the foregoing, it is one object of the present invention to provide a sealing system between at least a refrigerator door and the respective acclimatized chambers that provides an efficient sealing, but which maintains an acceptable manufacturing cost.

It is another object of the present invention to provide at least a low cost sealing gasket with good properties of variation absorption and traction resistance, compression resistance and torsion resistance.

It is another object of the present invention to provide at least one type of a sealing gasket having a long service life, which presents little distress when subjected to the efforts of compression and traction.

Finally, another object of the present invention is to provide at least a model of sealing gasket that can be installed in both the refrigerator door, and the front face of the refrigerator.

SUMMARY OF THE INVENTION

The present invention achieves the above objects by means of sealing system for a refrigerator, which comprises at least one gasket, at least one movable door of refrigerator and at least one fixed cabinet of refrigerator. At least one gasket comprises a tubular body formed by at least one attaching end and by at least one sealing body. At least one groove is defined in at least one movable door or at least one fixed cabinet. At least one rib is de-fined in at least one movable door or at least one fixed cabinet.

The gasket is physically coupled to the at least one movable door or to the at least one fixed cabinet through at least one groove, and the gasket is able to perform a hermetic sealing between at least one movable door and at least one fixed cabinet through the physical contact thereof with at least one rib.

Preferably, and in accordance with a preferred construction, the gasket comprises a cross-sectional tubular body defined by at least one attaching end and at least one sealing body. The attaching end of the gasket has an essentially triangular shape, and is pro-vided with at least one contact lateral projection, and at least an inner span portion. Still preferably, the sealing body comprises a tubular profile surrounding wall. The surrounding wall comprises at least an essentially semi-circular contacting groove and at least one inner damper. The damper comprises at least one resilient structure disposed within the perimeter defined by the surrounding wall. Optionally, the groove has a triangular profile and is essentially surrounding relative the acclimatized chamber of the refrigerator, and the rib has an essentially semi-circular profile.

Also preferably, the gasket is made either of elastomer or polymer.

In general, the gasket attachment, either to the movable door or to fixed cabinet, occurs by inserting the attachment end of the gasket in at least one groove defined by at least one movable door or at least one fixed cabinet. In this sense, the sealing provided by the gasket occurs through hermetically contacting the at least one fragment of the contact groove of the sealing body with at least one rib defined by at least one movable door or at least one fixed cabinet.

Optionally, it is provided another version for the sealing system for refrigerator, which comprises at least one gasket, at least one movable door of refrigerator and at least one fixed cabinet of refrigerator, at least one gasket comprising a tubular body formed by at least one attaching appendage and by at least one sealing body, and at least one rib is defined in at least one movable door, the gasket being physically coupled to the movable door, and being able to perform hermetic seal between at least one movable door and at least one fixed cabinet through the physical contact thereof with at least one fixed cabinet.

In this construction, the gasket comprises an essentially tubular body defined by at least one attaching appendage and at least one sealing body. The attaching appendage comprises a curved profile, in a similar format to the "C" letter.

In general, the gasket is attached to at least one movable door through the attaching appendage, the attaching appendage is inserted between the inner body and the outer body composing the movable door. The attaching appendage is fitted, in a surrounding manner, in the perimetral end of the inner body of the movable door. Preferably, at least one attaching appendage length of the gasket is contacted with the thermo-isolating expandable foam between the inner body and the outer body composing the movable door.

Also preferably, the gasket herein reported is made either of elastomer or polymer.

DETAILED DESCRIPTION OF THE INVENTION

According to the concepts of the present invention, it is disclosed a sealing system for refrigerator comprising at least one gasket 1, which is disposed between at least one movable door 2 and at least one fixed cabinet 3. The gasket 1 is intended to prevent escape of fluids (in this case, air) existing within an acclimatized chamber to the external environment, while it also has the function of preventing the inlet of external fluids within a refrigerated chamber. That is, the gasket 1 has the function of sealing, in a hermetic manner, the internal environment of a refrigerated chamber from the external environment.

Said gasket 1 can be attached to the movable door 2, or further to the fixed cabinet 3. The movable door 2, which preferably belongs to a refrigerator (not shown) is preferably attached in a pivoting manner to the fixed cabinet 3.

According to the proposed in the present invention, the novelties evinced herein provide two different aspects, namely: interaction of gasket 1 with the movable door 2, and interaction of gasket 1 with the fixed cabinet 3. In this context, it is ascertained that the gasket 1 is preferably made of a material having mechanical resiliency, such as elastomers or polymers.

Preferred Construction

Figure 1:
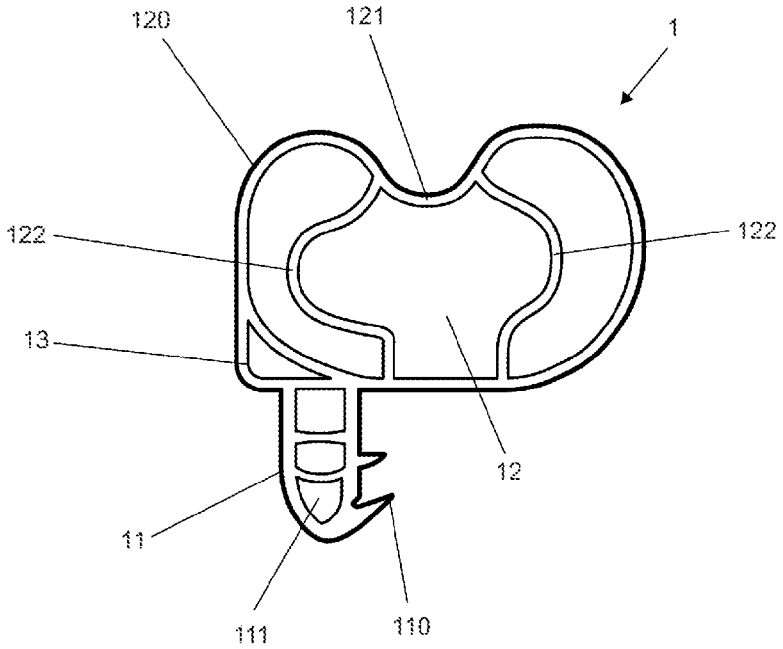
FIG. 1 illustrates the cross-sectional section of the preferred construction of the gasket belonging to the sealing system for refrigerator.
Figure 2:
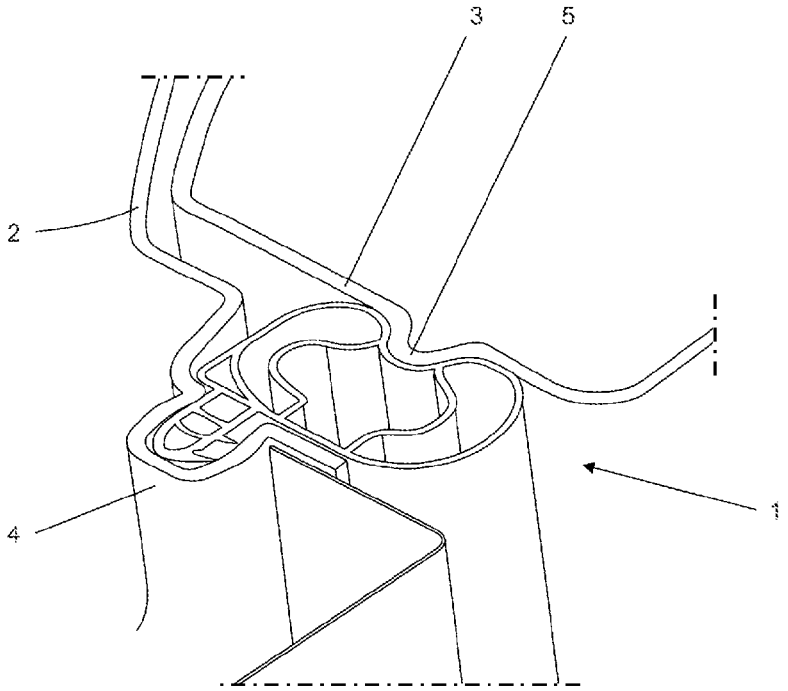
FIG. 2 illustrates, in a schematic manner, a first gasket arrangement of FIG. 1.
Figure 3:
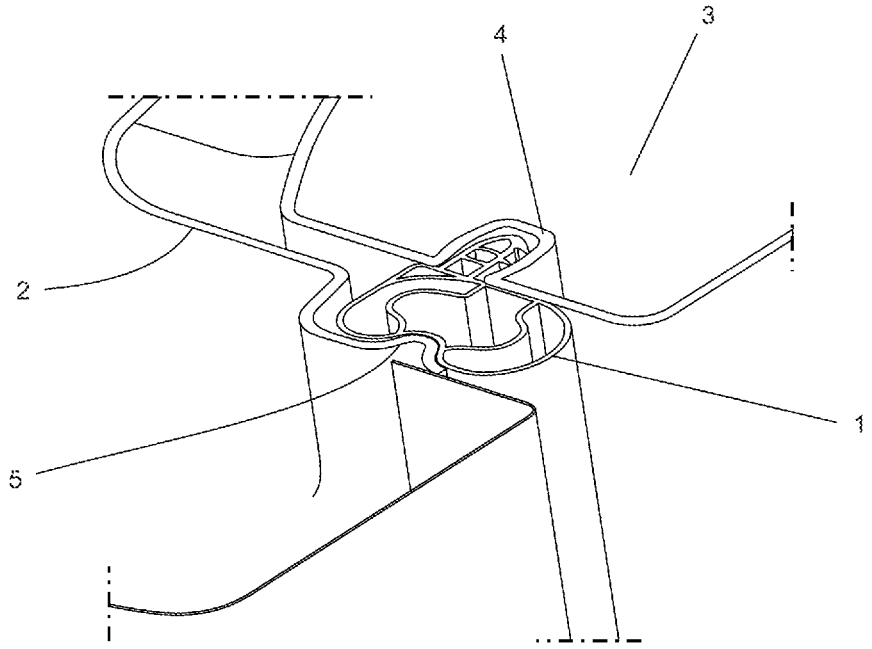
FIG. 3 illustrates, in a schematic manner, a second gasket arrangement of FIG. 1.

The preferred construction of the sealing system for refrigerator, according to the concepts of the present invention, is illustrated in FIGS. 1, 2 and 3.

In this preferred construction, the gasket 1 basically comprises a tubular body whose cross-sectional section comprises at least one attaching end 11 and at least one sealing body 12.

The attaching end 11 which is directed to attach the gasket 1 to the movable door 2 (FIG. 2) or to the fixed cabinet 3 (FIG. 3) comprises an essentially triangular shape, and is provided with at least one contact lateral projection 110, and at least an inner span portion 111, which helps possible mechanical deformations that occur when attaching said gasket 1.

The sealing body 12 comprises a surrounding wall 120, which defines an essentially oblong tubular profile.

Said surrounding wall 120 further has a mechanical reinforcement 13 disposed adjacent between the attaching end 11 and the mentioned sealing body 12.

The surrounding wall 120 comprises at least an essentially semi-circular contacting groove 121 and at least one inner damper 122. In the preferred construction herein reported, the dampers 122 include resilient walls preferably arranged perpendicularly inside the perimeter defined by the surrounding wall 120.

Although the gasket 1 has been detailed by portions composing it, it should further be evinced that all those portions are intact and joined. Thus, it is noticed that the gasket 1 can be industrially obtained by thermo-extrusion process or similar processes.

Attaching the gasket 1, either to the movable door 2 or to the fixed cabinet 3, occurs by inserting the attaching end 11 in at least one groove 4. In this context, the groove 4 may, exclusively, exist on the movable door 2 or on the fixed body 3. That is, the groove 4 may be made, in a selective and exclusive manner, either on the movable door 2 or on the fixed body 3, but not in both of them.

The groove 4 has an essentially triangular profile and is surrounding (relative to the acclimatized chamber (not shown)).

The sealing provided by gasket 1 occurs by hermetically contacting at least a section of the sealing body 12 (in particular, the contacting groove 121 of the sealing body 12 of gasket 1) with at least one rib 5. In this context, the rib 5 may exist, exclusively, on the movable door 2 or on the fixed body 3. That is, the rib 5 may be made, in a selective and exclusive manner, either on the movable door 2 or on the fixed body 3, but not in both of them.

The rib 5 has a profile that is analogous to the contacting groove profile 121 of the sealing body 12, that is, an essentially semi-circular profile.

In FIG. 2, it is illustrated the preferred construction of the sealing system herein reported, and the groove 4 is on movable door 2 and the rib 5 is on the fixed cabinet 3. More specifically, the groove 4 is shaped on the inner face of the movable door 2, in a surrounding manner (according to one of the acclimatized chambers present in the fixed cabinet 3). Also more specifically, the rib 5 is shaped on the outer face of the movable cabinet 3, in a surrounding manner (according to one of the present acclimatized chambers).

In FIG. 3, it is illustrated the preferred construction of the sealing system herein reported, the groove 4 being present on the fixed cabinet 3 and the rib 5 is present on the movable door 2. Also more specifically, the groove 4 is shaped on the outer face of the movable cabinet 3, in a surrounding manner (according to one of the present acclimatized chambers). Also more specifically, the rib 5 is shaped on the inner face of the movable door 2, in a surrounding manner (according to one of the acclimatized chambers present in the fixed cabinet 3).

In a coherent assembly of the elements integrating the preferred construction of the sealing system herein reported, regardless of the variations described herein above, it is noticed that the gasket 1 is physically attached to the groove 4 through the attaching end 11 thereof. It is important to mention that the gasket 1 is independently made.

In this assembly, the lateral (side) projections 110 end up acting as locking elements, as the inner span portions 111 aid deformation (fitting during the housing) of the attaching end as a whole. This fixing takes place without the need of any separate element, besides occurring in a simple and efficient manner.

The gasket 1 is able to perform sealing and shock absorption relative the contact thereof with the rib 5. Specifically, the contacting groove 121 is disposed in a aligned manner relative to the rib 5. In the event of contact between the gasket 1 and said rib 5 (either on the movable door 2, or on the fixed cabinet 3) the inner dampers 122 suffer from deformation and absorb potential impacts.

In this context, it remains noticing that the rib 5, together with the contacting groove 121, guarantees more robustness in what concerns absorption of variations of assembling process and positioning the movable door 2 relative to a fixed cabinet 3. This characteristic also optimizes the state of the art, after all, the current assembly of movable door to fixed cabinets, according to the current state of the art, can undergo misalignments, and those alignments usually cause sealing problems of the refrigerated chambers of the current refrigerators.

According to this assembly, interacting the gasket 1 with the rib 5 occurs efficiently and dynamically.

As previously mentioned, one of the innovative aspects of the present invention refers to the interaction between the gasket 1 and the groove 4 1 (whether on the movable door, or on the fixed cabinet 3).

The great news about this aspect is the fact that the attachment of the gasket 1 to the groove 4 lacks magnets and similar items. The absence of those elements (magnets and the like) considerably reduces the cost for the production of refrigerators with the sealing system disclosed herein. Of course, not using magnets and similar elements is only possible due to the constructiveness of gasket 1, and to the interaction between it and the groove 4.

Another innovative aspect of the present invention, also mentioned herein above, relates to the interaction between the gasket 1 with the rib 5 (either on the movable door 2, or on the fixed cabinet 3). The great news about this aspect is the fact of that any misalignments between the movable door 2 and the fixed cabinet 3 are fixed overcome by physical contact between the contacting groove 121 of gasket 1 and rib 5.

The sealing between the movable door 2 and the fixed cabinet 3 occurs always when both are kept in contact, preferably by external forces. That is, the sealing between the movable door 2 and the fixed cabinet 3, through the gasket 1, is kept by a physical force capable of pressing the movable door 2 against the fixed cabinet 3. In this sense, it should be noted that the source of physical force (not shown) comprises a source of physical force belonging to the current state of the art. Preferably, the following sources of physical force may be used: set of "male-female" locks disposed between the movable door 2 and the fixed cabinet 3; set of hinges with a torsion spring; among others.

Optional Construction

Figure 4:
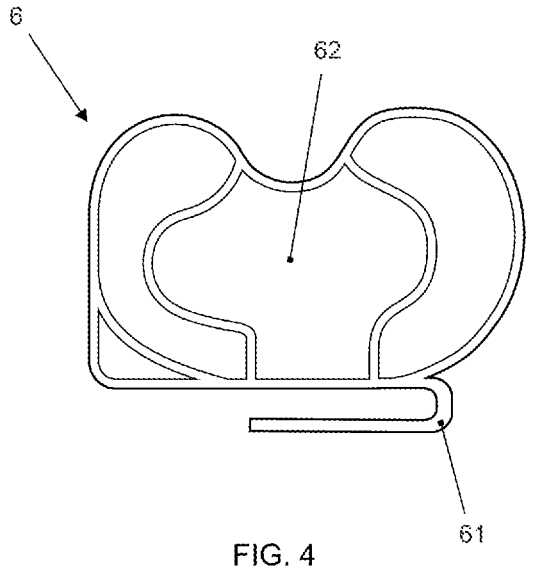
FIG. 4 illustrates the cross-sectional section of the optional construction of the gasket belonging to the sealing system for refrigerator.
Figure 5:
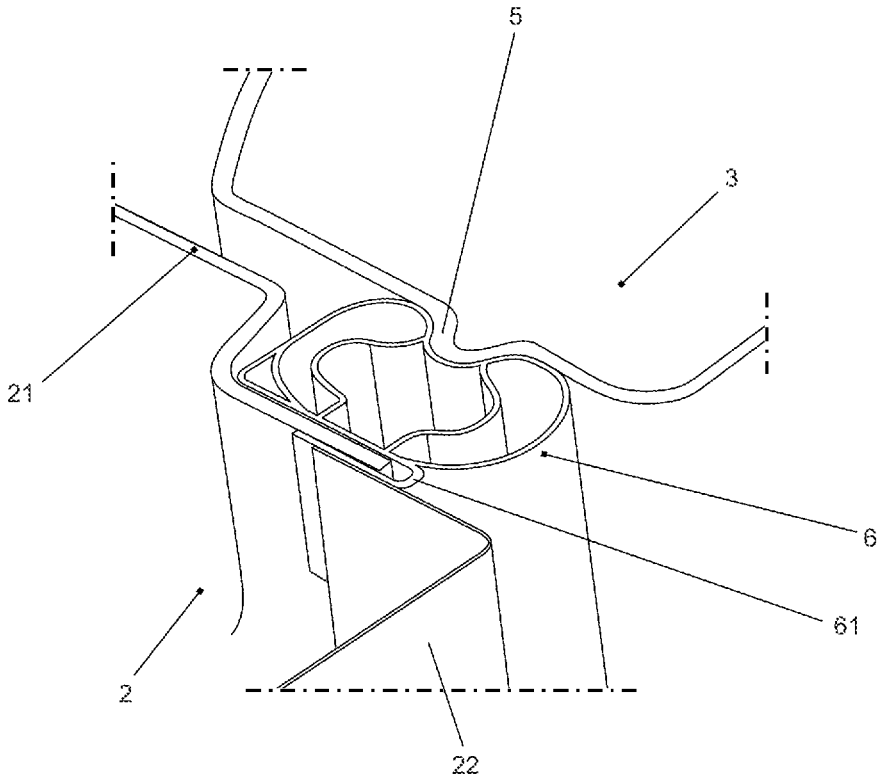
FIG. 5 illustrates, in a schematic manner, a gasket arrangement of FIG. 4.

The optional construction of the sealing system for refrigerator, according to the concepts of the present invention, is illustrated in FIGS. 4 and 5.

This is optional construction is fundamentally similar to the preferred construction described herein above, having only two different aspects over said construction.

The first differentiating aspect relates to the constructiveness of the gasket, hereinafter referenced as by indication 6.

The gasket 6 comprises an essentially tubular body whose cross-sectional section comprises at least one attaching appendage 61 and at least one sealing body 62.

The attaching appendage 61, which is directed for attaching to a movable door 2 of the gasket 6 comprises a curved profile, preferably shaped similar to the "C" letter.

The sealing body 62 of the gasket 6 is similar to sealing body 12 of the gasket 1, that is, it comprises a surrounding that defines an essentially oblong tubular profile, which presents at least one contacting groove and inner dampers.

The second differentiating aspect relates to the interaction between the gasket 6 and the movable door 2 previously recited. In this sense, it remains the evidence that the gasket 6, unlike the gasket 1, can only be attached to the movable door 2 (which is exempt from the previously described groove 4).

Therefore, and according to optional construction of the sealing system disclosed herein, the gasket 6 is attached to a movable door 2 of a refrigerator or the like (not shown) through the attachment appendage 61, which is inserted between the inner body 21 and outer body 22 composing the door 2.

As it is known to the ones skilled in the art, a refrigerator door or the like comprises an external body (normally metallic and that can be finished) and an inner body (usually plastic, which are shaped to the shelves and the like), these bodies being joined with the aid of an expandable heat-insulating foam (typically, polyurethane).

Therefore, and in accordance with the optional construction under discussion, the attaching appendage 61 of the gasket 6 is fitted, in a surrounding manner, to the perimetral end of the inner body 21 of door 2 before said inner body 21 is, usually metallic, and an inner body attached to the outer body 22. Thus, at least one attaching appendage length 61 of the gasket 6 is contacted with the expandable thermo-insulating foam, therefore getting attached to the door 2 in a permanent manner, thus ensuring a perfect fit.

It should further be mentioned that, as the gasket 6 is directly attached to the door 2, the rib 5 is also formed always shaped to the fixed cabinet 3.

The other aspects (efficiency and concept of sealing between a movable door 2 and a fixed cabinet 3) also previously explained are fully met through the gasket 6, herein referred to as the optional construction.

Having described examples of embodiment (preferable and optional), it should be understood that the scope of the present invention encompasses other possible variations, being limited just by the wording of the claims, including therein the possible equivalents thereof.

The invention claimed is:

1. A sealing system for a refrigerator, comprising at least one gasket, at least one movable door of refrigerator and at least one fixed cabinet of refrigerator, comprising:

the at least one gasket comprising a tubular body formed by at least one attaching end and by at least one sealing body, the at least one sealing body including a preformed semi-circular contacting groove;

at least one groove defined in the at least one movable door;

the at least one movable door comprising an inner face and the at least one fixed cabinet comprising an outer face, wherein at least one protruding rib is integrally formed on the outer face of the at least one fixed cabinet;

the at least one attaching end being physically coupled to the at least one groove to attach the at least one gasket to the at least one movable door; and the at least one gasket being able to perform hermetic seal between the at least one movable door and the at least one fixed cabinet through physical contact thereof when the at least one protruding rib fits within the semi-circular contacting groove.

2. The sealing system, according to claim 1, wherein the at least one gasket further comprises a cross-sectional tubular body defined by the at least one attaching end and the at least one sealing body.

3. The sealing system, according to claim 2, wherein the at least one attaching end of the at least one gasket has an essentially triangular shape, and is provided with at least one contact lateral projection, and at least an inner span portion.

4. The sealing system, according to claim 2, wherein the at least one sealing body comprises a surrounding wall having a tubular profile; the surrounding wall comprising at least one inner damper.

5. The sealing system, according to claim 4, wherein the at least one inner damper comprises at least one resilient structure disposed within the perimeter defined by the surrounding wall.

6. The sealing system, according to claim 1, wherein the at least one gasket is made of an elastomer.

7. The sealing system, according to claim 1, wherein the at least one gasket is made of a polymer.

8. The sealing system, according to claim 1, wherein the at least one groove has an essentially triangular profile and surrounding relative to an acclimatized chamber of the refrigerator.

9. The sealing system, according to claim 1, wherein the at least one protruding rib has an essentially semi-circular profile.

10. The sealing system, according to claim 1, wherein attachment of the at least one gasket, to the at least one movable door occurs by inserting the at least one attaching end of the at least one gasket to the at least one groove defined in the at least one movable door.

11. The sealing system, according to claim 1, wherein the hermetic sealing provided by the at least one gasket occurs by hermetically contacting a contact groove fragment of the at least one sealing body of the at least one gasket with the at least one protruding rib defined in the at least one movable door or the at least one fixed cabinet.

* * * * *